US005540651A

United States Patent [19]

Risch et al.

[11] Patent Number: 5,540,651

[45] Date of Patent: Jul. 30, 1996

[54] WATERPROOF HYDROTHERAPY BED

[75] Inventors: Thomas M. Risch, 101 Kettle Creek, Weston, Conn. 06883; Bryon Bourgeois, Bridgeport, Conn.

[73] Assignee: Thomas M. Risch, Weston, Conn.

[21] Appl. No.: 230,294

[22] Filed: Apr. 20, 1994

[51] Int. Cl.[6] ..... A61H 7/00

[52] U.S. Cl. ..... 601/148; 601/149; 5/918; 5/933; 160/392

[58] Field of Search ..... 5/451, 911, 912, 5/918, 933; 403/291; 160/391, 392, 395; 52/273, 222, 63; 601/148–150

[56] References Cited

U.S. PATENT DOCUMENTS

| | | | |
|---|---|---|---|
| 3,428,973 | 2/1969 | Hargest et al. | 5/912 X |
| 3,802,421 | 4/1974 | Williams | 601/158 X |
| 4,274,234 | 6/1981 | Abell | 52/273 X |
| 4,316,308 | 2/1982 | Chatelain | 160/392 X |
| 4,498,205 | 2/1985 | Hino | 5/912 X |
| 4,776,050 | 10/1988 | Goodwin | 5/912 X |
| 4,853,988 | 8/1989 | Mutzell | 601/148 |
| 4,937,898 | 7/1990 | Mutzell | 601/148 X |
| 5,008,965 | 4/1991 | Vfzalik | 5/912 X |
| 5,074,286 | 12/1991 | Gillaspie et al. | 601/148 |
| 5,314,403 | 5/1974 | Shaw | 601/148 |

FOREIGN PATENT DOCUMENTS

| | | | |
|---|---|---|---|
| 317009 | 5/1989 | European Pat. Off. | 5/912 |
| 4002070 | 12/1990 | Germany | 601/154 |

*Primary Examiner*—Robert A. Hafer
*Assistant Examiner*—Brian E. Hanlon
*Attorney, Agent, or Firm*—David P. Gordon

[57] ABSTRACT

A hydrotherapy bed includes a substantially water-tight enclosure having an open top. The top of the enclosure is covered by an upper and lower layer of thin rubber having an intermediate layer of thixotropic gel approximately one half inch thick. The rubber layers are mounted in a peripheral groove using a strip of T-shaped molding and a supporting net is mounted beneath the lower rubber layer in another peripheral groove by attaching edge loops of the net to a plastic coated half hinge which is inserted into the peripheral groove. A pair of parallel tracks is mounted inside the enclosure and an array of upwardly directed water jets is carried on a cross member which is movable along the tracks. The cross member is coupled to an endless cable wound around pulleys mounted at ends of the tracks. One of the pulleys is coupled to a motor which drives the cross member along the tracks. The cable is kept from crossing over itself on the drive pulley by threading it through a TEFLON® block having spaced apart orthogonal holes. The motor driving the cross member is provided with an encoder which encodes the position of the cross member and reed switches at opposite ends of the tracks provide additional position information for calibrating the encoder. The encoder, the reed switches, and the motor are coupled to a processor having a memory and a hand held control is used for setting the speed, direction and cycle of cross member movement.

17 Claims, 6 Drawing Sheets

WATERPROOF HYDROTHERAPY BED

BACKGROUND OF THE INVENTION

1. Field of the Invention

The invention relates to an apparatus for massaging the human body with pressurized water jets. More particularly, the invention relates to a full length water-proof bed having an interior chamber with a movable carriage carrying water jets which face upward from beneath the bed.

2. State of the Art

Hydrotherapy has long been accepted as a valuable method of physical and psychological healing. Traditionally, hydrotherapy has been provided in a whirlpool tub or other "wet" environment where pressurized jets of warm water are directed at the body to transmit a massaging effect. Recently, hydrotherapy has been made available in a "dry" environment by providing a waterproof bed with interior water jets. Pressurized water from the interior jets is directed upward against a flexible top surface of the waterproof bed. The bed is typically large enough to support the full length of an adult in the supine or prone position.

One early example of a waterproof bed for hydrotherapy is disclosed in U.S. Pat. No. 4,635,620 to Ricchio. Ricchio teaches a waterbed mattress having a fixed array of upwardly directed water jets arranged along the interior bottom of the mattress. The mattress is filled with water which supports a person on a top membrane of the mattress. Heated pressurized water is directed from the jets toward the top membrane of the mattress. Plumbing associated with the water jets is enclosed in a bed frame which supports the mattress. Ricchio's apparatus provides a relaxing massage for a person lying on the waterbed mattress. However, the points of massage are fixed by the fixed locations of the water jets. In addition, the force of the jets is damped by the water filled mattress since the water exiting the jets must travel through the water in the mattress before striking the top membrane of the mattress.

More recently, it has been known to provide movable water jets beneath a waterproof membrane in order to control the points of massage during hydrotherapy. Hydrotherapy beds with movable water jets are disclosed in U.S. Pat. Nos. 4,757,808 to Effler, Jr., 4,853,988 to Mützell, and 4,976,256 to Marlin et al. These beds typically include a waterproof bed frame having a water reservoir and an array of upwardly directed water jets mounted on a movable carriage. The carriage is movable by an electromechanical drive mechanism which may include pulleys and cables or gears. A flexible membrane is fitted across the top of the bed frame with a waterproof seal. Unlike Ricchio's waterbed, the flexible membrane in these beds is not supported by water. There is open space between the movable water jets and the flexible membrane so that the jets exert a greater force against the underside of the membrane. While the hydrotherapy beds having movable jets provide much better hydrotherapy than the beds having fixed jets, they are very noisy. When water from the jets strikes a portion or the membrane which is not underlying the person lying on the bed, the force of the water jets (which are typically pulsating) causes the membrane to vibrate. The absence of any damping agent on either side of the membrane permits the vibrating membrane to generate a loud sound. The loud sound is somewhat amplified by reverberation in the open space between the jets and the flexible membrane.

Until now, most of the improvements in hydrotherapy beds with movable water jets have been directed to the electromechanics of moving the jets. Effler, Jr., supra., shows a rather complex worm gear arrangement which moves a carriage back and forth along the length of the bed while simultaneously rotating a pair of water jets. M ützell, supra., discloses a single movable water jet which is coupled to an indicator arm located over the person lying on the bed. The indicator arm projects a beam of light down onto the person and the single jet is movable in a Cartesian coordinate system to precisely locate the single jet under the person lying on the bed according to the position of the beam of light. Marlin et al., supra., teach a virtually self-supporting membrane beneath which, jets are mounted on a cross member which is movable on parallel tracks by remote control. Position sensors are provided to determine when the cross member is at either extreme end of the tracks, at which time, movement of the cross member is automatically reversed. A microprocessor is included so that the movement of the cross member may be limited to a range within the extreme ends of the track. While Marlin et al. discloses several good "ideas", the details of implementing these ideas are absent from the disclosure. It is unclear how the membrane is mounted and held in place without any underlying support. It is suggested that an optional net be placed under the membrane for further support, but is is not disclosed how the net is mounted. A microprocessor is shown coupled to two extreme position sensors, but it is not disclosed how the microprocessor determines a position other than the extreme positions.

While some of the prior art devices use cables and pulleys to move the water jet(s), others choose a more complex and expensive gear drive arrangement because it is difficult to make the cable and pulley arrangement operate reliably. None of the prior art patents addresses the issue of noise, which is considerable when the space between the water jets and the top membrane is not filled with water.

SUMMARY OF THE INVENTION

It is therefore an object of the invention to provide a waterproof hydrotherapy bed having a sound damping mechanism which does not significantly diminish the massaging force of the water jets.

It is also an object of the invention to provide a simple and inexpensive means for mounting an upper membrane and an underlying supporting net in a hydrotherapy bed.

It is another object of the invention to provide a transport mechanism for water jets which is inexpensive but reliable.

It is still another object of the invention to provide a controller for controlling the transport mechanism which is easy to use and which allows selective limiting of the location and movement of the water jets.

In accord with these objects which will be discussed in detail below, the hydrotherapy bed of the present invention includes a substantially water-tight enclosure having an open top. A pair of parallel tracks is mounted inside the enclosure and an array of upwardly directed water jets is carried on a cross member which is movable along the tracks. The cross member is coupled to a cable which is wound around at least two pulleys which are mounted at opposite ends of the enclosure. One of the pulleys is coupled to an electric motor which rotates the pulley and thereby drives the cross member along the tracks. The jets on the cross member are coupled to a water pump which recirculates and pressurizes water from inside the enclosure into the jets and a heat exchanger is provided inside the enclosure for cooling the pump with the recirculated water. A temperature sensor coupled to a cooling fan maintains the water temperature below 104 F.

According to a first aspect of the invention, the open top of the enclosure is covered by an upper and lower layer of thin rubber having an intermediate layer of thixotropic gel which is approximately one half inch thick. Alternatively, the intermediate layer can be formed of an approximately one half inch thick sheet of low density foam which is saturated with water or a similar liquid such as glycerine based mineral oil, or can be formed of any other substance of suitable density and viscosity. The intermediate layer provides an efficient damping of the sound made by water from the jets striking the underside of the lower rubber layer. However, the viscosity and density of the intermediate layer is such that it is spread into a very thin layer under the weight of a person lying on the bed. When a person lays on the bed, the upper and lower sheets of rubber effectively contact each other at substantially all points directly beneath the person's body, and the intermediate layer is spread out from beneath the person's body to the spaces between the rubber layers which surround the person's body. This results in an increased sound damping effect in all areas surrounding the person's body and allows the force of the water jets to be felt, without the damping influence of the intermediate layer, in the places where the person's body is located. The person's body provides sound damping in the areas where it is located. The thin rubber layers feel good to the touch, are comfortable to lay on and allow efficient transmission of the force of the water jets when not separated by the intermediate layer.

A second aspect of the invention is to mount the two rubber layers with their intermediate layer in a first peripheral groove in a top portion of the enclosure using a strip of T-shaped molding which holds a peripheral portion of the two rubber layers in the first peripheral groove.

A third aspect of the invention is to mount a supporting net beneath the lower rubber layer by providing a second, relatively deep, peripheral groove interior of the first peripheral groove and to attach each edge of the net to a plastic coated half of a piano hinge which is then inserted into the second peripheral groove.

A fourth aspect of the invention is to provide a cable and pulley arrangement for moving the jet carrying cross member in which an endless cable is kept from crossing over itself by threading it through a TEFLON block having spaced apart orthogonal holes. According to this aspect of the invention, four idler pulleys are arranged at respective ends of the two tracks. A drive pulley is mounted directly above the idler pulley at a first end of the first track and a fifth idler pulley is mounted directly beneath the idler pulley at the first end of the the second track. An endless drive cable is wrapped around the drive pulley three times in order to assure sufficient friction between the drive pulley and the drive cable. The drive cable extends from the drive pulley to the first idler pulley at the second end of the first track, wraps 180 degrees around the first idler pulley and returns to the second idler pulley which is beneath the drive pulley. The cable wraps more than 90 degrees around the second idler pulley and extends transversely to the third idler pulley at the first end of the second track. The cable wraps approximately 270 degrees around the third idler pulley and extends to the fourth idler pulley at the second end of the second track. The cable wraps 180 degrees around the fourth idler pulley and returns to the fifth idler pulley which is mounded directly below the third idler pulley. The cable wraps more than 90 degrees around the fifth idler pulley and crosses transversely back to the drive pulley. The cable thus crosses over itself at approximately 90 degrees at the drive pulley and at the third idler pulley. In order to prevent the cable from climbing over itself on the drive pulley, the cable is passed through a first TEFLON block having orthogonal spaced apart holes. In order to prevent the cable from rubbing against itself where it crosses itself on entry to the third idler pulley, a second TEFLON block may be provided. A fifth aspect of the invention is to provide an improved circuit for controlling water temperature, water pressure and the position of the jet carrying cross member. According to this aspect of the invention, the motor driving the cross member is provided with an encoder which encodes the position of the cross member at all times. Reed switches at opposite ends of the track on which the cross member is driven provide additional position information for calibrating the encoder. The encoder, the reed switches and the motor are coupled to a processor which is also coupled to water temperature and pressure transducers and a timer. A small hand held control is coupled to the processor and is provided with switches for adjusting the water pressure, the speed of cross member movement, the direction of cross member movement, and the position of the cross member. The processor is provided with a memory and is responsive to the hand held control so that the movement of the cross member may be programmed to cycle between any two points on the tracks as determined by the encoder and the reed switches.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
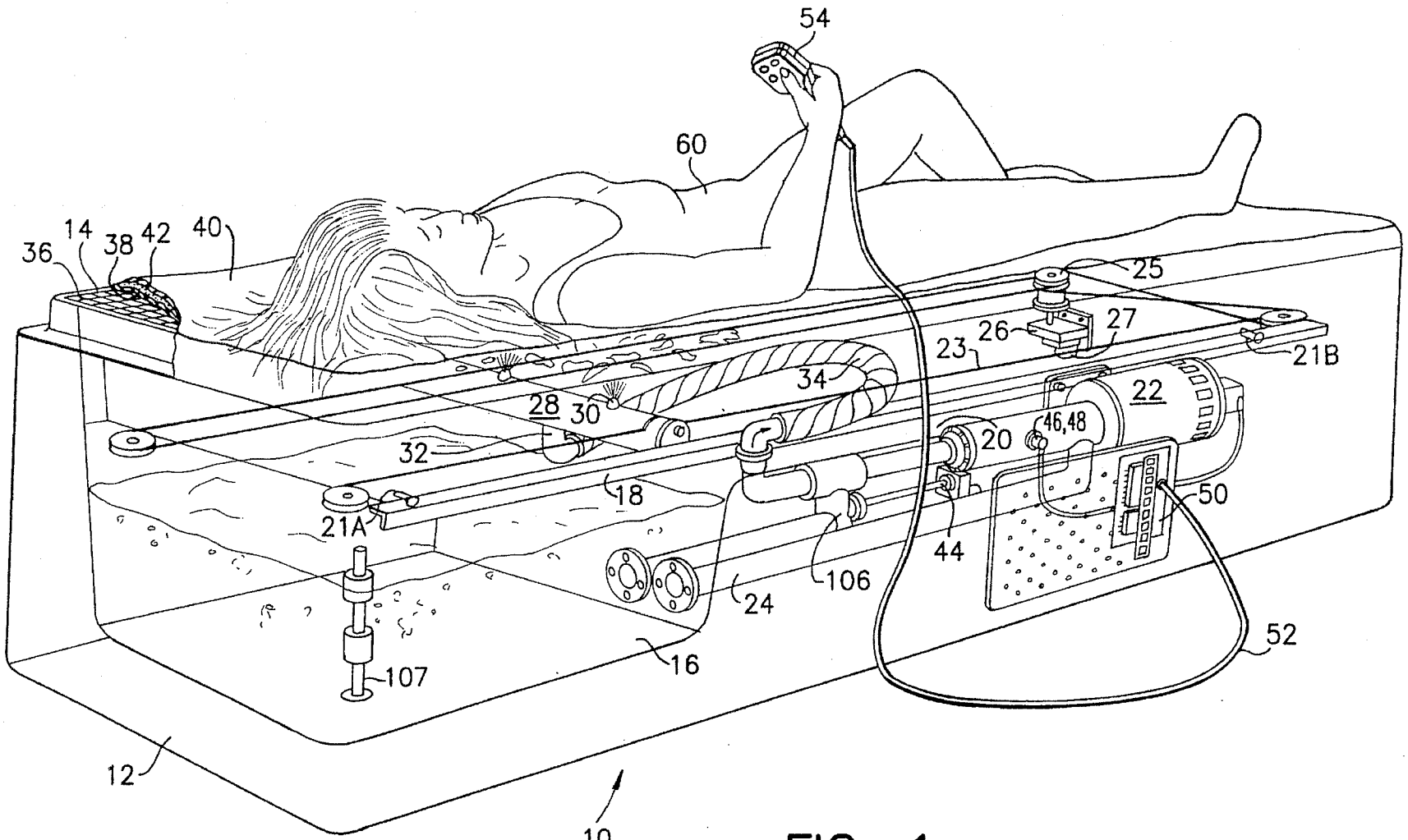
FIG. 1 is a perspective transparent view, partially cut away, showing the presently preferred embodiment of the invention.

Turning now to FIG. 1, the waterproof hydrotherapy bed 10 according to the invention generally includes a watertight, preferably fiberglass or thermoformed plastic, enclosure 12 having an open top 14 and an interior water reservoir 16. The water reservoir 16 is isolated from the remainder of the interior of the enclosure by a raised ledge 20 which is preferably inclined to allow water to run off the ledge 20 into the reservoir 16. A pair of parallel tracks 18 are mounted above the reservoir 16 and below the open top 14 and extend substantially the entire interior length of the enclosure 12. A cross member 28 is mounted on the tracks 18 and is movable along substantially the entire length of the tracks 18. The cross member is provided with a plurality of upstanding water jets 30 which are in fluid communication with the interior of the cross member 28, which is in fluid communication with a water coupling member 32 on the underside of the cross member 28. According to a presently preferred embodiment, the cross member 28 is a water jet manifold. A water pump 22 is located beneath the ledge 20 and is thereby protected from water in the reservoir 16 and on the ledge 20. The pump 22 is coupled to the reservoir 16 by a first water conduit 24 and is coupled to the cross member 28 by a second water conduit 34, which preferably includes a flexible hose. As will be described in more detail below, water is pumped by the pump 22 from the reservoir 16 through the jets 30 and collected back into the reservoir 16. A heat exchanger 44 is preferably provided between the pump 22 and the first water conduit 24 and the temperature and pressure of the water pumped through the jets 30 is preferably monitored by a temperature sensor 46 and a pressure sensor 48. An endless cable 23 is coupled to the cross member 28, to a plurality of idler pulleys, described below with reference to FIG. 4, and to a drive pulley 25 which is coupled to a reversible DC electric gear motor 26. The gear motor 26 is provided with a position encoder 27 and a reed switch 21*a*,21*b* is located at each extreme end of the track to sense when the cross member is at an extreme position. As described in more detail below, when the motor 26 is activated, the cable and pulley arrangement drives the cross member along the tracks so as to move the location of the water jets 30. The water pump 22, a pressure relief controller 44, the temperature sensor 46, the pressure sensor 48, the motor 26, the position encoder 27 and the reed switches 21*a*,21*b* are all coupled to a controller circuit 50 which is also coupled by a cable 52 to a hand held controller 54. The presently preferred embodiment of the invention is approximately eighty-three inches long, approximately thirty inches wide, approximately twenty-two inches deep and has a water reservoir capacity of approximately fifteen gallons.

According to a first aspect of the invention, the open top 14 of the enclosure 12 is covered by a supporting net 36 which supports a lower layer of thin rubber 38 and an upper layer of thin rubber 40. According to the presently preferred embodiment, the layers of rubber are approximately 0.015 to 0.032 inches thick, preferably 0.020 inches thick, and the upper layer may be slightly thicker than the lower layer. An approximately one half inch thick layer of thixotropic gel 42 is placed between the lower layer of thin rubber 38 and the upper layer of thin rubber 40. Alternatively, the layer 42 may be formed from a one half inch thick sheet of low density foam saturated with water or other liquid such as mineral oil. From the foregoing, those skilled in the art will appreciate that when the pump 22 is activated, water is pumped from the reservoir 16 through the jets 30 and is directed upward against the lower layer of rubber 38. The thixotropic gel 42 absorbs much of the energy, and thereby damps the sound, of the water impacting on the underside of the lower layer of thin rubber 38. However, when a person 60 lies on top of the upper thin layer of rubber 40, as shown in FIG. 1, the upper layer 40 is pressed against the lower layer 38 which is supported by the net 36. The thixotropic gel 42 is dispersed so that the two layers of thin rubber which underlie the body of the person 60 are pressed together against the net 36 with little or no thixotropic gel between them. The energy of the water which impacts these portions of the lower layer of thin rubber 38 is absorbed by the body of the person 60 in the form of a soothing massage.

Figure 2:
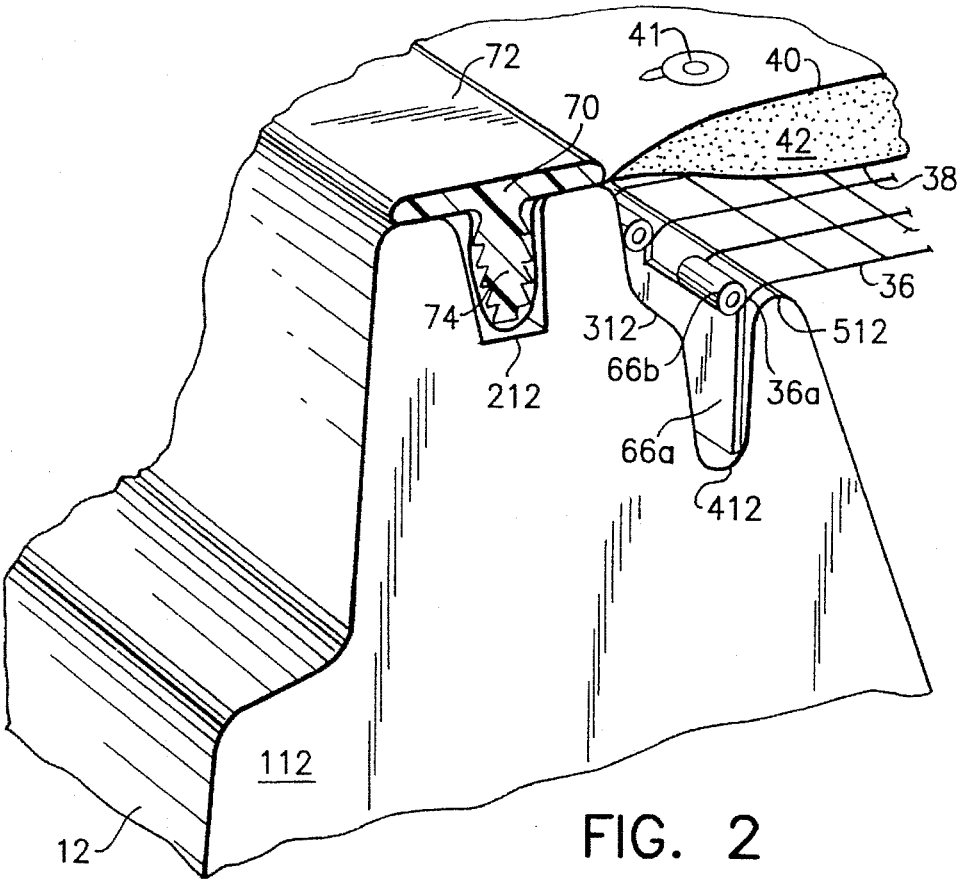
FIG. 2 is an enlarged broken cross sectional view along line 2—2 of FIG 1.
Figure 3:
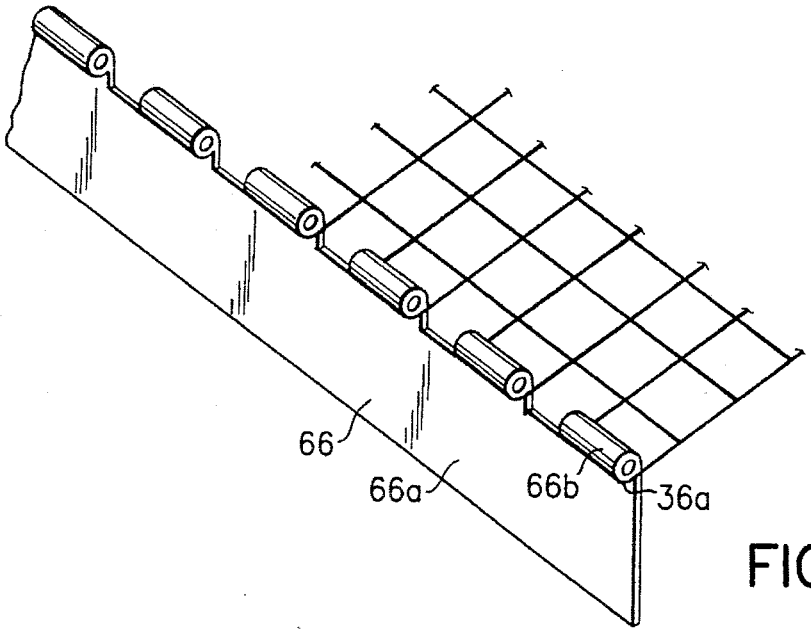
FIG. 3 is an enlarged perspective view of a portion of the supporting net and the net mounting device.

FIG. 2 shows how the layers of rubber and the supporting net are mounted on the top of the enclosure 12 according to the second and third aspects of the invention. A side wall 112 of the enclosure 12 is preferably approximately five inches wide and formed of ¼ inch thick hollow fiberglass or thermoplastic. The uppermost outer portion of the sidewall 112 is provided with an outer peripheral groove 212 which is preferably approximately three sixteenths inch wide and seven sixteenths inch deep. A lower ledge 312 is formed interior of the groove 212 and a lower interior groove 412 is provided in the ledge 312. A higher lip 512 is provided interior of the groove 412. The lower interior groove 412 is preferably approximately one quarter inch wide by approximately three quarters inch deep. The supporting net 36 is attached to the lower interior groove 412 of the walls 112 of the enclosure 12 with the aid of a supporting member mounting strip which preferably takes the form of a half hinge 66 which is shown in more detail in FIG. 3. The half hinge 66 has a flat plate 66*a* with a number of evenly spaced apart knuckles 66*b* on one of its edges. The end loops 36*a* of the supporting net 36 are looped around the knuckles 66*b* as shown in FIG. 3 and the flat plate 66*a* is inserted in the groove 412 as shown in FIG. 2. In the presently preferred embodiment of the invention, the half hinge is literally one half of a piano hinge which is plastic coated by dipping. However, those skilled in the art will appreciate that any object having a similar strength and structure may be used. The half hinge and groove mounting of the supporting net has proved to be effective and inexpensive as well as simple to assemble.

The two layers of thin rubber 38 and 40 are mounted on the uppermost outer portion of the sidewalls 112 in the outer peripheral groove 212 with the aid of a lock-fitting T-molding 70. The T-molding 70 has a relatively broad smooth top 72 and a barbed downward extending central tongue 74. According to the invention, the two layers of thin rubber 38 and 40 are placed on top of each other and on top of the outer peripheral groove 212. The T-molding 70 is then placed with its tongue 74 on top of the two layers of thin rubber 38 and 40 and is pressed into the groove 212. The barbed tongue 74 frictionally engages the the two layers of thin rubber 38 and 40 and the groove 212 as will be understood by those skilled in the art. The thixotropic gel 42 may be placed between the two layers of thin rubber 38 and 40 prior to mounting as described. It is preferred, however, that the top layer of rubber 40 be provided with a valve 41 for filling and draining the thixotropic gel 42 and to release any excess air from between the two layers of thin rubber 38 and 40.

Figures 4, 4A:
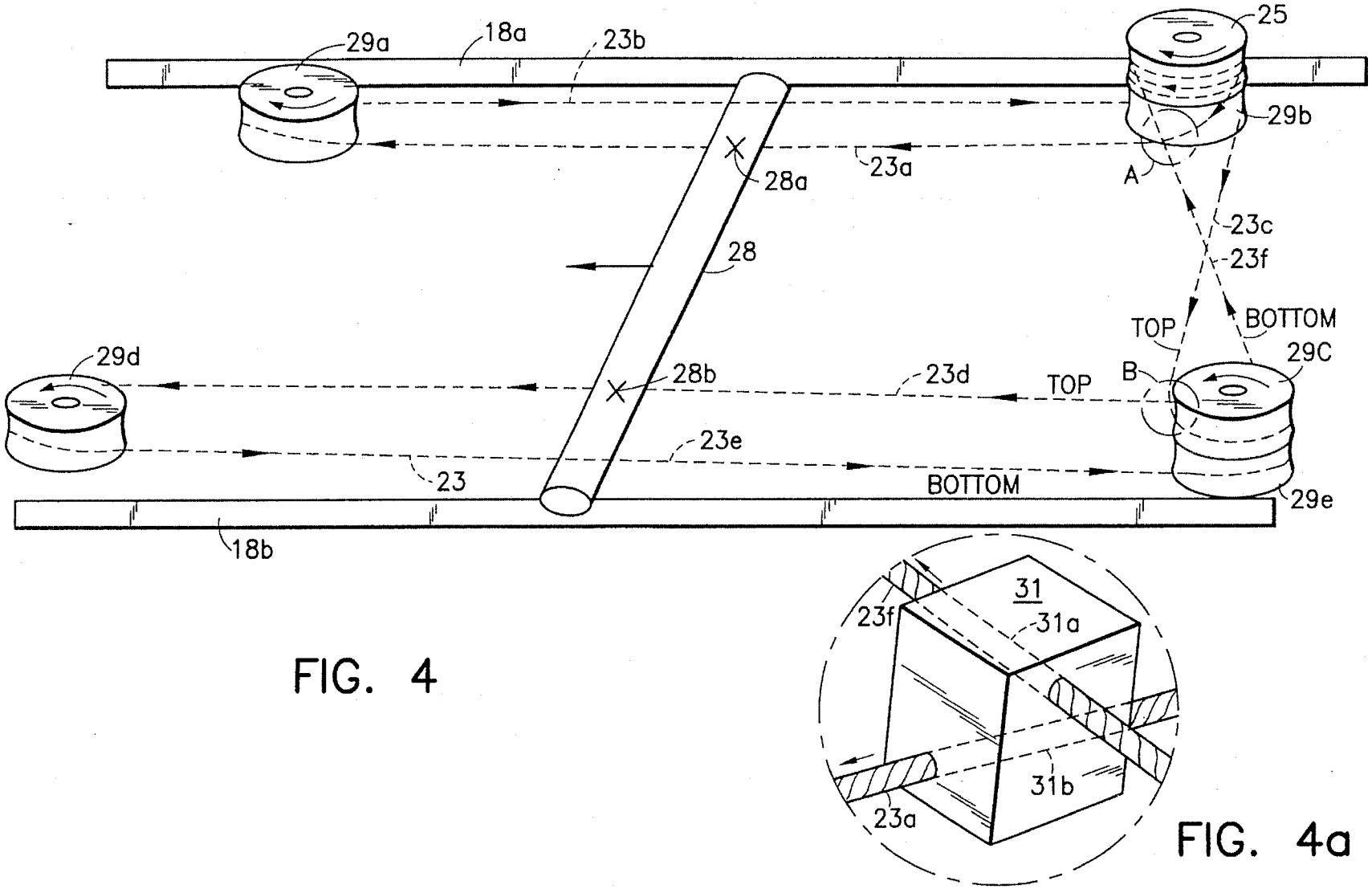
FIG. 4 is a schematic perspective view of a portion of the cable and pulley arrangement showing the placement of the TEFLON block according to the invention.
FIG. 4*a* is an enlarged detail of the circled portion A in FIG. 4.

Another aspect of the invention is related to the pulley and cable drive mechanism which is shown schematically in FIG. 4. Referring now to FIGS. 1 and 4, an endless cable 23 is wrapped around five idler pulleys 29*a*–29*e* and a drive pulley 25. Starting at the drive pulley 25, the cable 23 is wrapped around the drive pulley 25 three times in order to assure sufficient friction between the drive pulley 25 and the drive cable 23. The drive cable 23 extends from the drive pulley 25 along a first segment 23*a* to the first idler pulley 29*a* at the second end of the first track 18*a*, wraps 180 degrees around the first idler pulley 29*a* and returns along a second segment 23*b* to the second idler pulley 29*b* which is beneath the drive pulley 25. The cable 23 wraps more than 90 degrees around the second idler pulley 29*b* and extends transversely along a third segment 23*c* to the third idler pulley 29*c* at the first end of the second track 18*b*. The cable 23 wraps approximately 270 degrees around the third idler pulley 29*c* and extends along a fourth segment 23*d* to the fourth idler pulley 29*d* at the second end of the second track 18*b*. The cable 23 wraps 180 degrees around the fourth idler pulley 29*d* and returns along a fifth segment 23*e* to the fifth idler pulley 29*e* which is mounted directly below the third idler pulley 29*c*. The cable 23 wraps more than 90 degrees around the fifth idler pulley 29*e* and crosses transversely back to the drive pulley 25 along a sixth segment 23*f*. The cable 23 thus crosses over itself at approximately 90 degrees at the drive pulley 25 where segments 23*a* and 23*f* cross, and at the third idler pulley 2 29*c* where segments 23*c* and 23*d* cross. In order to prevent the cable 23 from climbing over itself on the drive pulley 25, the cable 23 is passed through a first TEFLON (polytetrafluorethylene) block 31 having orthogonal spaced apart holes 31*a* and 31*b* as shown in FIG. 4*a*. It will be appreciated that the relative orthogonal movement of the cable segments 23*a*,23*f* relative to each other through the holes in the TEFLON block keep the TEFLON block in a substantially stationary position. In order to prevent the cable 23 from rubbing against itself where segments 23*c* and 23*d* cross over each other, a second TEFLON block may be provided in a similar manner at the point B shown in FIG. 4. From the foregoing, it will be appreciated that cable segments 23*a* and 23*d* move synchronously in the same direction, e.g. toward the idler pulleys 29*a*, 29*d* when the drive pulley is rotated in one direction, e.g. clockwise as shown in FIG. 4. According to the invention, the cross member 28 is attached at points 28*a*, 28*b* to cable segments 23*a*, 23*d* respectively and is thereby moved by the cable 23 in the direction noted and may be moved in the opposite direction by reversing the rotation of the drive pulley 25. As mentioned above, since the drive pulley 25 is coupled to the reversible drive motor 26, operation of the drive motor 26 in a clockwise or counter clockwise direction will move the cross member towards one end or the other of tracks 18*a*, 18*b*.

Figure 5:
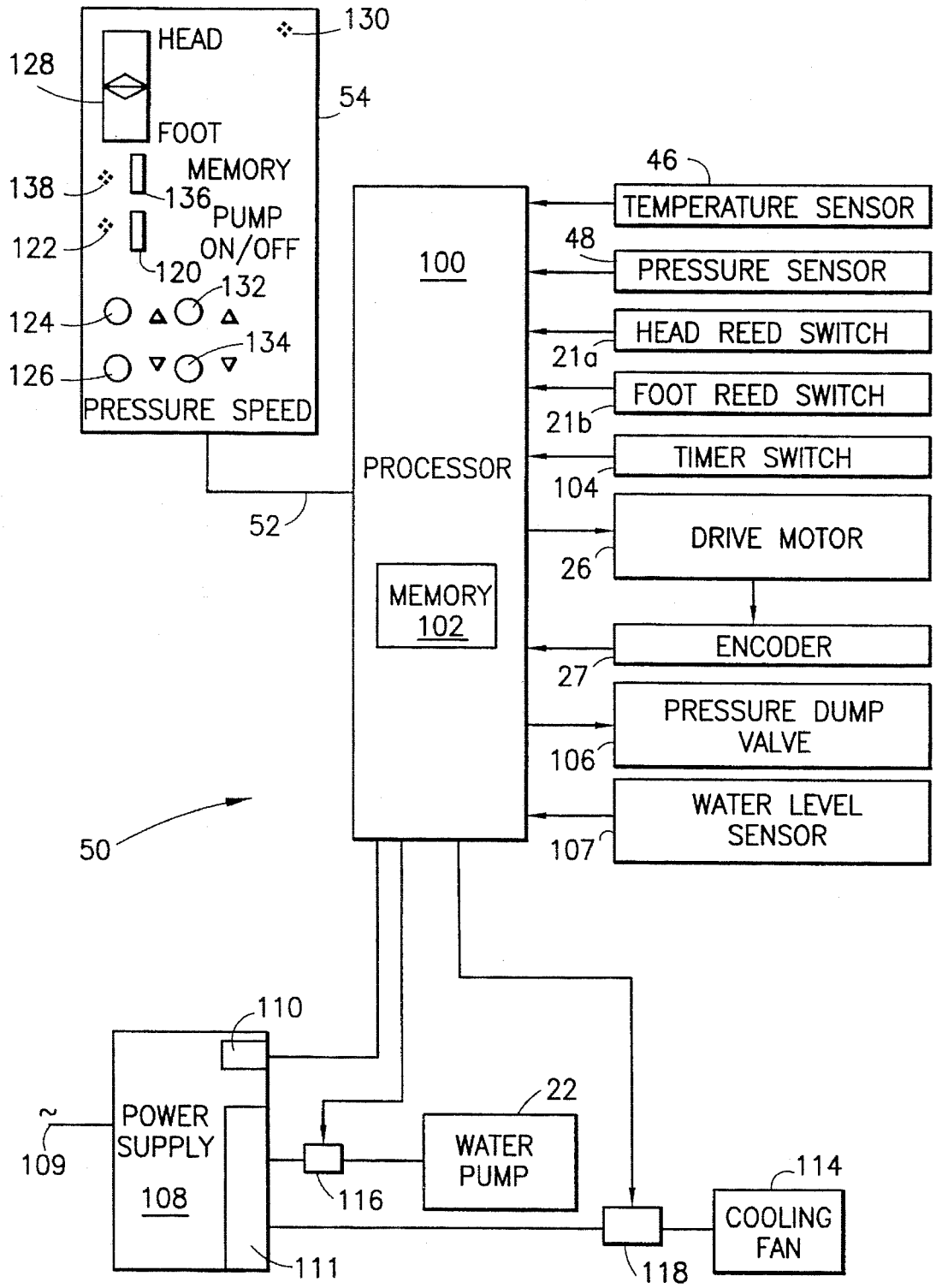
FIG. 5 is a block diagram of the improved control circuit according to the invention.

Turning now to FIG. 5, the controller circuit 50 of the invention includes a processor 100 having a memory 102. As mentioned briefly above, the processor 100 is coupled to and receives input from the temperature sensor 46, the pressure sensor 48, the head and foot reed switches 21*a*, 21*b*, a timer switch 104, the drive motor position encoder 27, and a water level sensor 107. In addition, the processor 100 is coupled to and provides a controlling output to the drive motor 26, and a pressure dump valve 106. A dual voltage power supply 108 is coupled to AC mains 109 and provides a low DC voltage 110 for the processor 100, the drive motor 26, and the pressure dump valve 106, as well as providing line level AC voltage 111 for the water pump 22 and a cooling fan 114 for cooling the heat exchanger (44 in FIG. 1). AC voltage to the water pump 22 is controlled by a SCR or servo 116 which is coupled to and receives input from the processor 100. Similarly, the cooling fan 114 is controlled by controller 118 which is coupled to and receive input from the processor 100. As mentioned above, a hand held controller 54 is coupled to the processor 100 by a cable 52. The hand held controller includes several switches and indicator lights which aid the user in the operation of the invention. According to a presently preferred embodiment of the invention, the hand held controller 54 includes a pump on/off push button 120 and a pump ON indicator light 122. Push buttons 124 and 126 are provided for respectively increasing and decreasing water pressure. A rocker switch or thumb joy stick 128 is provided for changing the direction of movement of the cross member (28 in FIGS. 1 and 4).. Push buttons 132 and 134 are provided for respectively increasing and decreasing the speed of movement of the cross member. A memory push button 136 is also provided and a memory indicator light 138 is provided to signal when the memory function is activated. The memory function is described in more detail below with reference to FIG. 6. An auxiliary indicator light 130 is provided to indicate when water level is low and/or when maximum or minimum pressure has been selected. As mentioned above, the temperature sensor 46 may be pre-set to maintain the water temperature below a selected threshold. Alternatively, a temperature selector may be provided to adjust the water temperature threshold. The timer switch 104 might be provided in the hand held unit 54 or provided on a separate control panel on the enclosure 12 (FIG. 1). The pressure relief valve 106 may be coupled to the pump 22 and operated by the pressure relief control motor 44. Typically, the operation of the invention will begin by selecting a time on the timer switch 104, reclining on the bed and then activating the pump ON switch 120. At this starting point, the cross member will be located at the foot position and the pressure will be at minimum. Pressure is increased to a desired level using the pressure increase button 124 and the rocker switch 128 is pressed towards the Head position. In this starting mode of operation, the movement of the cross member will be responsive to the pressing of the switch 128. The speed of movement is adjustable with buttons 132, 134. Automatic operation of the invention is described below with reference to FIG. 6.

Figures 6, 6A:
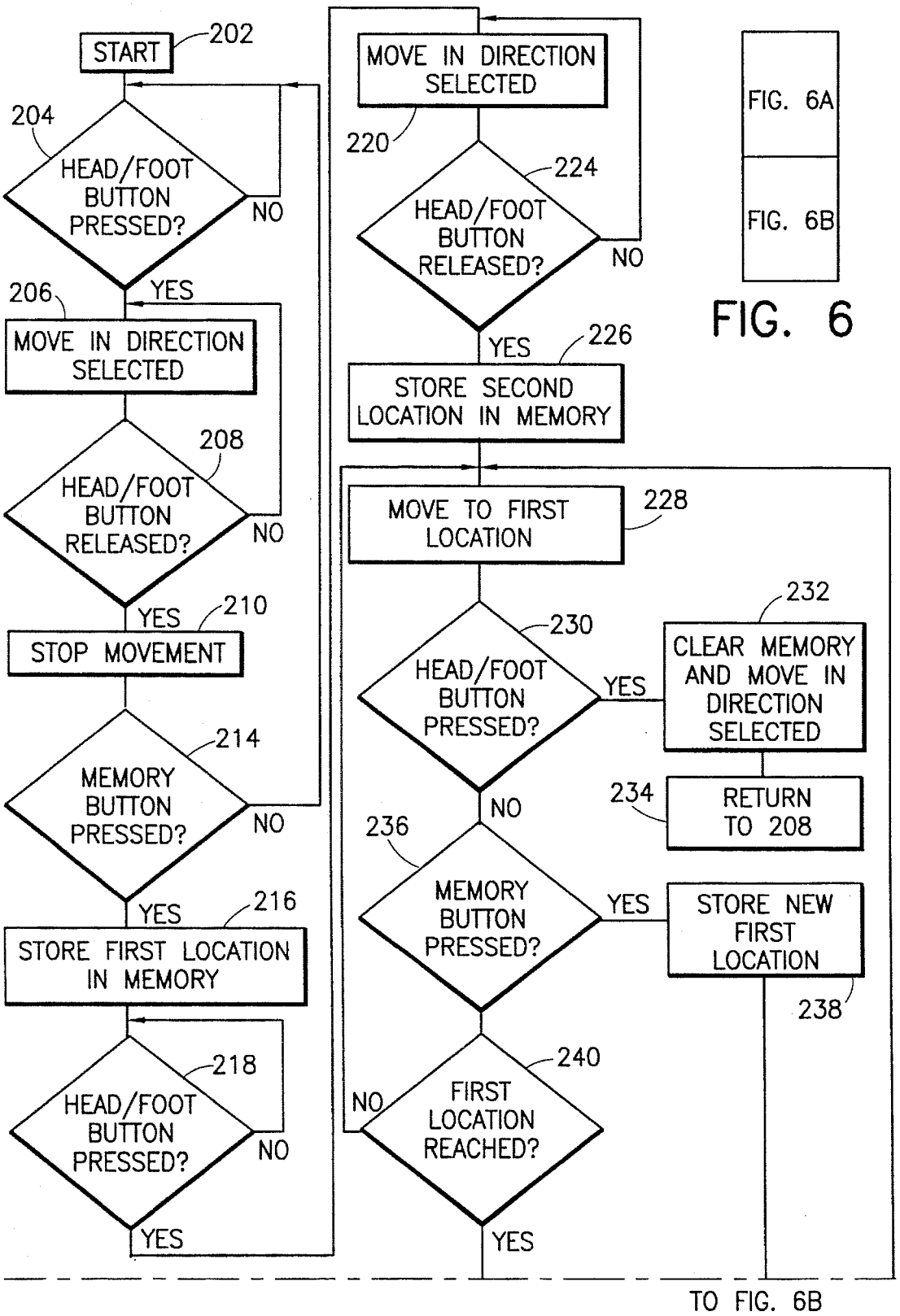
FIG. 6 is a flow chart of the operation of the processor in FIG. 5 for controlling movement of the jet carrying cross member.
Figure 6B:
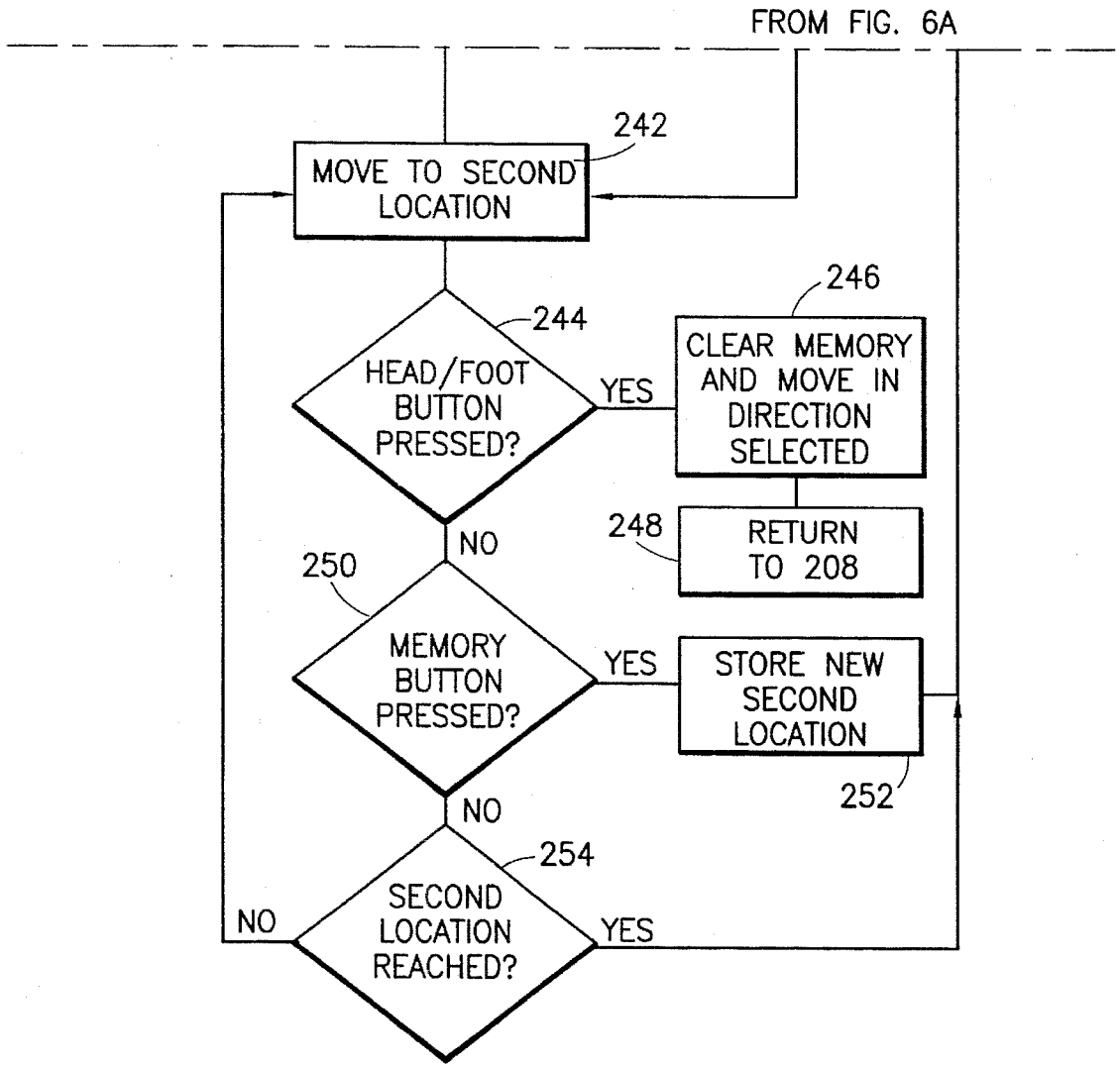

Turning now to FIG. 6, and with reference to FIG. 5, the control circuit described above is provided with a means for controlling the travel cycle of the cross member. That is, the circuit can be programmed to move the cross member back and forth in a cycle between any two selected points on the tracks. The routine outlined by the flowchart in FIG. 6 is started at 202 when the unit is turned on. The processor 100 monitors the Head/Foot rocker switch at 204 and if it is pressed, starts the drive motor 26 and moves the cross member in the direction selected at 206. The processor 100 continues to monitor the rocker switch 128 at 208 and when it senses that the switch has been released, it stops movement of the cross member at 210 where it waits for the memory button to be pressed at 214 or the Head/Foot button to be pressed again at 204. If the memory button is pressed at 214, the memory light 138 is illuminated on the hand controller 54 and the current (first) location of the cross member as determined by the encoder 27 is stored in the processor memory 102 at 216. The processor 100 continues to monitor the Head/Foot rocker switch 128 at 218. When the switch 128 is pressed, the processor, at 220, starts the drive motor 26 and moves the cross member in the direction selected. The processor 100 continues to monitor the rocker switch 128 at 224 and when it senses that the switch has been released, it stores at 226 the current (second) location of the cross member as determined by the encoder 27 in its memory 102. The processor then reverses the motor 26 at 228 and moves the cross member in the reverse direction towards the first location while monitoring both the Head/Foot button and the memory button at 230 and 236 respectively. If the Head/Foot button is pressed at 230, the memory is cleared and the cross member is moved in the direction selected at 232. At this point the processor returns at 234 to monitoring the Head/Foot switch at 208 as described above. If, however, while moving the cross member to the first location, the memory button is pressed at 236, a new first location is stored at 238 and the cross member movement is reversed at 242 to return to the currently stored second location. If, during movement to the first location, no button is pressed, the processor waits at 240 until the first location is reached before reversing movement of the cross member and moving toward the second location at 242. Similarly, while the cross member is moving towards the currently stored second location, the processor monitors both the Head/Foot button and the memory button at at 244 and 250 respectively. If the Head/Foot button is pressed at 244, the memory is cleared and the cross member is moved in the direction selected at 246. At this point the processor returns at 248 to monitoring the Head/Foot switch at 208 as described above. If, however, while moving the cross member to the second location, the memory button is pressed at 250, a new second location is stored at 252 and routine returns to 228 where the cross member movement is reversed to return to the currently stored first location. If, during movement to the second location, no button is pressed, the processor waits at 254 until the first location is reached before reversing movement of the cross member and moving toward the first location by returning to 228. This programming of the processor 100 allows the user to set a massage cycle for a specific part of the body, e.g. the lower back, to the exclusion of other parts of the body. Moreover, as will be appreciated from the above description, the operation of this program is very simple and requires only a few moments of training. In an alternate embodiment of the routine described above, the second memory location is not stored unless the memory button is pressed a second time (between 224 and 226 in the diagram of FIG. 6). The first or second embodiment of the routine may be user selectable by means of switch, typically a DIP switch (not shown) on the circuit board containing the processor.

Also, as mentioned above, the timer switch 104 will interrupt this routine when the selected time has elapsed. When the time has elapsed, the processor returns the cross member to the foot position and reduces the water pressure to the minimum.

There have been described and illustrated herein several embodiments of a waterproof hydrotherapy bed. While particular embodiments of the invention have been described, it is not intended that the invention be limited thereto, as it is intended that the invention be as broad in scope as the art will allow and that the specification be read likewise. Thus, while particular dimensions have been disclosed, it will be appreciated that other dimensions could be utilized. Also, while specific materials have been shown, it will be recognized that other types of materials having the same or similar properties could be used with similar results obtained. Moreover, while particular configurations have been disclosed in reference to the cross member, the water jets, the water pump and the water reservoir, it will be appreciated that other configurations could be used as well. Furthermore, while the invention has been disclosed as having several novel features, it will be understood that different combinations of these features can selectively achieve the same or similar results as disclosed herein. It will therefore be appreciated by those skilled in the art that yet other modifications could be made to the provided invention without deviating from its spirit and scope as so claimed.

We claim:

1. A waterproof hydrotherapy bed for use by a reclining patient, comprising:

a) a substantially water-tight enclosure having an open top;

b) a first layer of flexible material covering said open top;

c) a second layer of flexible material covering said first layer of flexible material, said first and second layers of flexible material being peripherally coupled to each other to form a substantially fluid-tight interspace between said first and second layers of flexible material;

d) at least one upwardly directed water jet mounted in said enclosure below said first layer of flexible material; and e) a layer of fluid filler material in said interspace, said interspace being of a size and said filler material having a viscosity such that said filler material disperses between said first and second layers of flexible material when said first and second layers are pressed together by the weight of the reclining patient, and said filler material absorbing energy and reducing audible noise produced by water from said water jet striking said first layer of flexible material where said first and second layers are not pressed together by the weight of the reclining patient.

2. A waterproof hydrotherapy bed according to claim 1, wherein:

said first and second layers of flexible material are thin rubber.

3. A waterproof hydrotherapy bed according to claim 1, wherein:

said fluid filler material comprises thixotropic gel.

4. A waterproof hydrotherapy bed according to claim 1, wherein:

said fluid filler material comprises a sheet of low density foam saturated with liquid.

5. A waterproof hydrotherapy bed according to claim 1, wherein:

said open top is provided with a peripheral groove and peripheral portions of said first and second layers of flexible material are held in said peripheral groove.

6. A waterproof hydrotherapy bed according to claim 5, further comprising:

a T-shaped molding strip having a flat top and a central tongue, said central tongue being inserted in said peripheral groove on top of said first and second layers of flexible material.

7. A waterproof hydrotherapy bed according to claim 1, further comprising:

a layer of supporting material coupled to said enclosure below said first layer of flexible material.

8. A waterproof hydrotherapy bed according to claim 7, wherein:

said layer of supporting material is a net.

9. A waterproof hydrotherapy bed, comprising:

a) a substantially water-tight enclosure having an open top and an interior peripheral ledge below said open top, said interior peripheral ledge having a groove;

b) a first layer of flexible waterproof material covering said open top;

c) a flexible supporting member mounted below said first layer of flexible waterproof material;

d) a supporting member mounting strip formed from half a hinge having a first hinge portion which fits into and is received by said groove and a second hinge portion which couples with said flexible supporting member, said flexible supporting member extending substantially orthogonal to said first hinge portion when said first hinge portion is received by said groove and said second hinge portion is coupled to said flexible supporting member; and d) at least one upwardly directed water jet mounted in said enclosure below said flexible supporting member.

10. A waterproof hydrotherapy bed according to claim 9, wherein:

said flexible supporting member is a net.

11. A waterproof hydrotherapy bed according to claim 10, wherein:

said second hinge portion of said supporting member mounting strip comprises a plurality of spaced apart projections.

12. A waterproof hydrotherapy bed according to claim 11, wherein:

said plurality of spaced apart projections are curved projections.

13. A waterproof hydrotherapy bed according to claim 9, wherein:

said supporting member mounting strip is plastic coated.

14. A waterproof hydrotherapy bed, comprising:

a) a substantially water-tight enclosure having an open top;

b) a flexible layer covering said open top;

c) a pair of parallel spaced apart tracks mounted in said enclosure below said flexible layer;

d) a cross member, movably mounted on said tracks;

e) at least one upwardly directed water jet mounted on said cross member;

f) a driving pulley mounted at a first end of a first one of said tracks;

g) a first idler pulley mounted at a second end of said first one of said tracks;

h) a second idler pulley-mounted at a first end of a second one of said tracks;

i) a third idler pulley mounted at a second end of said second one of said tracks;

j) an endless cable wrapped around each of said pulleys so that said endless cable crosses over itself in at least one place;

k) a low friction block having two spaced apart through bores, said endless cable passing through said through bores at said at least one place.

15. A waterproof hydrotherapy bed according to claim 14, wherein:

said spaced apart through bores are substantially perpendicular to each other.

16. A waterproof hydrotherapy bed according to claim 14, wherein:

said low friction block is polytetrafluorethylene.

17. A waterproof hydrotherapy bed according to claim 14, wherein:

said endless cable is wrapped three times around said driving pulley and said at least one place is adjacent said driving pulley.

* * * * *